United States Patent [19]

Namisato

[11] Patent Number: 4,839,874

[45] Date of Patent: Jun. 13, 1989

[54] ELECTRONIC WATCH WITH MOVING MEMBER

[75] Inventor: Tooru Namisato, Tokyo, Japan

[73] Assignee: Seiko Instruments Inc., Tokyo, Japan

[21] Appl. No.: 243,594

[22] Filed: Sep. 12, 1988

[30] Foreign Application Priority Data

Sep. 17, 1987 [JP] Japan ..... 62-141817[U]
Dec. 22, 1987 [JP] Japan ..... 62-195638[U]

[51] Int. Cl.[4] ..... G04B 19/00; G04B 19/06

[52] U.S. Cl. ..... 368/76; 368/223; 368/229

[58] Field of Search ..... 368/76, 80, 155–157, 368/160, 134, 165, 179, 223, 228–229

[56] References Cited

U.S. PATENT DOCUMENTS 3,978,654 9/1976 Koike et al. ..... 368/155
4,712,925 12/1987 Beebe ..... 368/223
4,734,895 3/1988 Grosskopf ..... 368/229

*Primary Examiner*—Vit W. Miska
*Attorney, Agent, or Firm*—Bruce L. Adams; Van C. Wilks

[57] ABSTRACT

An analog type electronic watch having a step motor to drive hands has a movement indicator other than hands. The movement indicator has a magnet member and is driven with the magnetic influence of a rotor magnet of the step motor. The magnet member is arranged within a window provided in a dial plate of the watch within the range of the magnetic force of the rotor. The movement indicator is supported so as to be synchronously moved with the rotation of the rotor under the magnetic influence.

8 Claims, 9 Drawing Sheets

ELECTRONIC WATCH WITH MOVING MEMBER

BACKGROUND OF THE INVENTION

1. Field of the Invention

The present invention relates to an analog type electronic watch for indicating the time by driving a gear train with a step motor which is composed of a rotor, a stator and a coil block, more particularly to an analog type electronic watch having a moving member other than hands for indicating that the watch is actually moving and providing visual variations to attract the consumer.

2. Description of the Prior Art

An analog type electronic watch according to the reference to FIGS. 22, 23 and 24. In the two-handed (i.e., hour and minute hands) watch having a long step time (i.e., once for every 20 or 30 seconds), as shown in FIG. 22, the motion angle $\theta$ of the hand per step is 2 degrees for the step of 20 seconds and 3 degrees for the step of 30 seconds so that it cannot be clearly observed. In another character watch having motions other than those of the hands, as shown in FIGS. 23 and 24, the rotational torque of a rotor 1 for each second is transmitted through a wheel 22 to rotate a disk turning wheel 21. As a result, a disk 20 attached to the journal of the disk wheel 21 and printed with the picture of the dial of a telephone is rotated to express motions in combination of the telephone printed on a dial plate 22 with a background picture *7c* such as a character picture. Thus, the character watch of the prior art is generally made to have such mechanical structure.

In the two-handed watch having the long step time, however, the motion angle $\theta$ of the minute hand 10 at one time is 2 degrees for the step of 20 seconds and 3 degrees for the step of 30 seconds, as shown in FIG. 3, and a long time has elapsed before a next hand step comes. In order to confirm whether or not the watch actually moves, several minutes have to be awaited to make a judgement in view of the position change of the minute hand 13. This confirmation may take a long time and make the user anxious about it. Since, moreover, the character watch of the prior art uses the rotations of the disk, its motions may be monotonous and less attractive for the user.

SUMMARY OF THE INVENTION

It is therefore an object of the present invention to provide an electronic watch which is enabled to keep the user from any anxiety about the time.

It is another object of the invention to provide an electronic watch which is easy to confirm whether or not the watch actually moves.

It is further object of the invention to provide an electronic watch which has visual variations to attract the consumer.

It is still further object of the invention to provide an electronic watch which is able to expand its design in various mode and for various purpose.

These and other object of the invention are accomplished by an electronic watch which comprises a step motor including a rotor, a stator and a coil block, a dial plate having a window portion within the range of the magnetic force of the rotor, a magnetic member provided in said window so as to move synchronously with the rotation of said rotor for indicating the watch movement and supporting means for supporting said magnetic member.

BRIEF DESCRIPTION OF THE DRAWINGS

A full understanding of the present invention will be obtained from the detailed description of the preferred embodiments presented hereinbelow, and the accompanying drawings, which are given by way of illustration only and are not intended to be limitative of the present invention, and wherein:

FIG. 3 is a vertical section taken along line B—B of FIG. 1

FIG. 4(*b*) is a schematic plane view in another condition used to explain the function of the invention;

FIG. 4(*c*) is a schematic plane view used to explain the function of the invention;

FIG. 14(*b*) is a vertical section in the other condition used to explain the function of the invention;

DETAIL DESCRIPTION OF THE PREFERRED EMBODIMENTS

Figure 1:
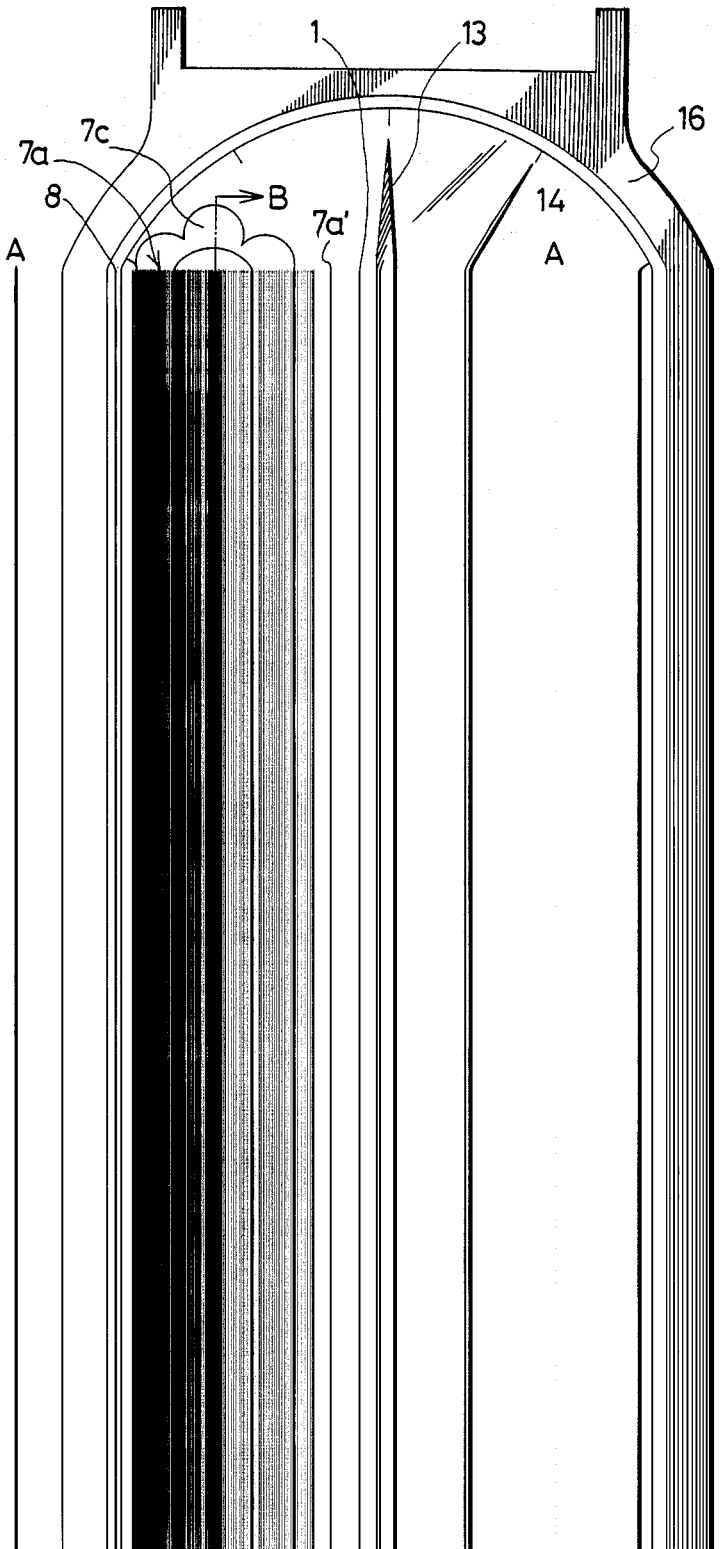
FIG. 1 is a top plane view showing an analog type electronic watch according to the present invention.
Figure 2:
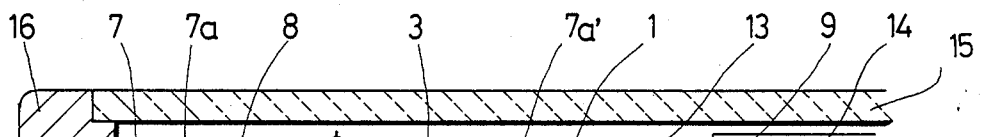
FIG. 2 is a vertical section taken along line A—A of FIG. 1

One embodiment of the present invention will be described in detail in the following with reference to FIGS. 1, 2 and 3. Designated at reference numeral 2 is a spring member having its one end press-fitted in its anchor base 6, which in turn is press-fitted in a base plate 8. On the other end of the spring member 2, there is fixedly supported, through an adhesive 5 or the like a magnetic plate 3 which is planarly divided into N and S poles. The magnetic plate 3 has its surface formed with a picture such as a butterfly, bird or insect. Designated at numeral 7 is a dial plate which is formed with a rectangular window 7*a* in a position corresponding to the magnetic plate 3. The window 7*a* has its angulate wall 7*a*' surrounding the magnetic plate 3 so that this magnetic plate 3 may not be moved more than necessary when it is attracted by a rotor 1. The dial plate 7 is formed in its back with a sweeping area 7*b* for establishing neither planar nor sectional engagement with the spring member 2 even if the latter moves. The surface of the dial plate 7 is printed with a background picture 7*c* which corresponds to the picture displayed on the magnetic plate 3. For smooth motions, there are formed clearances: a clearance t between the surfaces of the magnetic plate 3 and the dial plate 7 for eliminating any contact between an hour hand 12 and the magnetic plate 3; and a clearance u between the spring member 2 and the base plate 8 for eliminating any contact inbetween. Next, the positional relation between the magnetic plate 3 and the rotor magnet 1*a* of the rotor 1 will be described in the following. The magnetic plate 3 is so arranged that the position of the strongest magnetic force of the S (or N) pole of the magnetic plate 3 may fall at the position of the strongest magnetic force of the N or S pole of the magnet 1*a* while the rotor 1 stands still and that the magnetic plate 3 may fall within the range of the magnetic action between itself and the magnet 1*a*.

The anchor base 6 is fixed in the base plate 8 in the present embodiment but may be fixed in a receiving member or the like with similar operations effects, if the base plate can be replaced by the receiving member.

The remaining structural parts are identical to those of the mechanism of the three-handed analog type electronic watch of the prior art. This mechanism will be briefly described in the following, including the not-shown portions. If drive pulses are fed once per second to the coil by a not-shown circuit, the magnetic poles N and S are generated around the rotor hole of the stator 9 to repulse and attract the N and S poles of the magnet 1*a* of the rotor 1 so that the rotor magnet 1*a* is rotated. The rotor 1 has its rotations transmitted through several gear trains to rotate a seconds hand 14, a minute hand 13 and the hour hand 12.

Figure 4A:
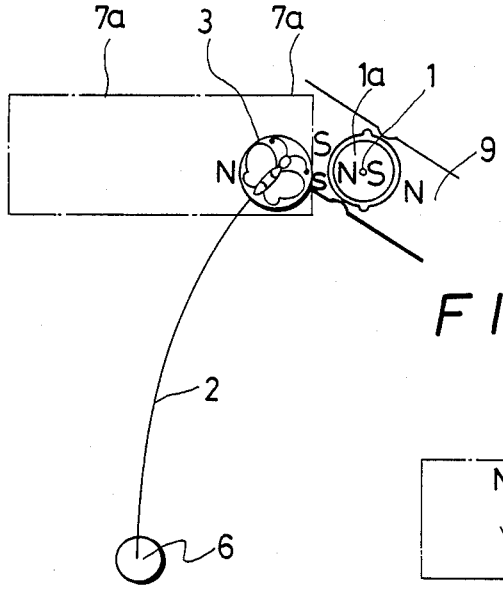
FIG. 4(*a*) is a schematic plane view used to explain the function of the invention.
Figure 4B:
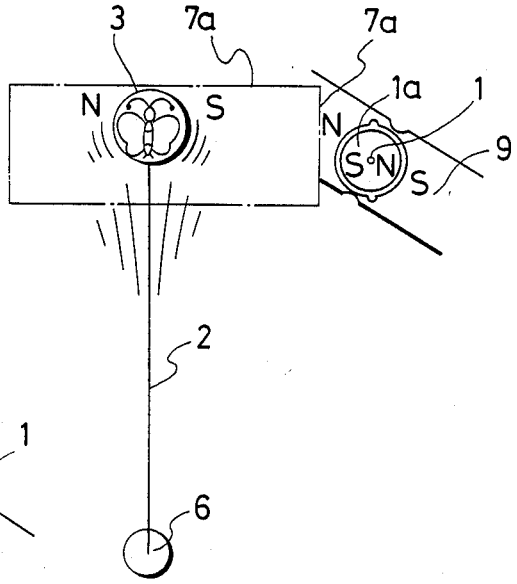
Figure 4C:
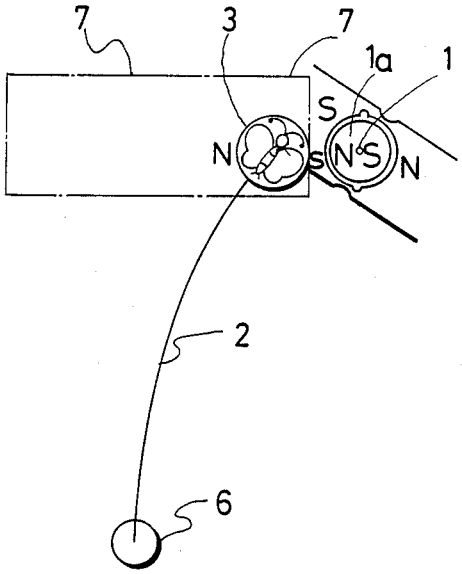

FIGS. 4(*a*), 4(*b*) and 4(*c*) are top plan views showing an essential portion for explaining the operational relation between a rotor 1 and a magnet plate 3. The present device uses the mechanism of the analog type electronic watch of the prior art as it is. In a three-handed analog type electronic watch having seconds, minute and hour hands, the rotor 1 makes a rotation of 180 degrees for every second.

As shown in FIG. 4(*a*), a stator 9 establishes S and N poles alternately for rotating the rotor 1 so that the rotor 1 has its magnet 1*a* rotated by the magnetic poles of the stator 9. As a matter of fact, the rotor 1 stops its rotations slightly after the magnetic poles of the stator 9 disappear, but the explanations will be made for conveniences, assuming a simultaneous stop. Since the magnetic plate 3 has its S pole arranged at the N-pole side of the magnet 1*a* of the rotor 1, an attraction is established between the magnet 1*a* of the rotor 1 and the magnetic plate 3 so that the magnetic plate 3 is attracted by the rotor 1 until it is stopped at the angulate wall 7*a*' of a window 7*a* of the dial plate. As a result, the butterfly looks as if it stood still through the dial plate. In this state, moreover, a spring member 2 is flexed toward the rotor 1.

FIG. 4(*b*) shows the state after one second from the state of FIG. 4(*a*), in which a pole opposite to that of FIG. 4(*a*) is established in the stator 9 so that the rotor 1 makes a rotation of 180 degrees. The magnetic pole of the magnet 1*a* of the rotor 1 in a position corresponding to the magnetic plate 3 has changed from the N to S poles. As a result, the magnetic plate 3 is abruptly brought away from the rotor 1 by the repulsion and the deflection of the spring member 2, and the spring member 2 and the magnetic plate 3 are rocking for a while. If the magnetic plate 3 of FIG. 4(*a*) to 4(*c*) is observed together with the background picture 7*c* of the dial plate 7 shown in FIG. 1, the butterfly having stood still in the state of FIG. 4(*a*) looks as if it moved to the flower in the state of FIG. 4(*b*) and were flying over the flower. FIG. 4(*c*) shows the state after one period from the state of FIG. 4(*b*) to restore the state of FIG. 4(*a*). The magnetic plate 3 is attracted by the action of the magnet 1*a* of the rotor 1 and stands still at the angulate wall 7*a*' of the window 7*a* of the dial plate. If observed from the state of FIG. 4(*b*) to the state of FIG. 4(*c*), the butterfly having been flying in FIG. 4(*b*) looks as if it stood still in FIG. 4(*c*). Next, the state is changed to FIG. 4(*b*) and further to FIG. 4(*c*) and FIG. 4(*a*), and these changes are repeated every one minute.

Upon each rotation of the rotor 1 of 180 degrees for each second, the magnet 1*a* of the rotor 1 has its N and S poles changed to attract or repulse the magnetic plate 3 corresponding to the pole of the magnet 1*a* so that it rocks through the spring member 2. If a suitable picture is adhered to the magnetic plate 3, it looks as it were moved or stopped by the rocking motions.

The time period for which the spring member 2 is rocking can be adjusted according to the length, width, thickness and material of the spring member itself and the weights of the magnetic plate 3 and a picture plate 4.

Figure 5:
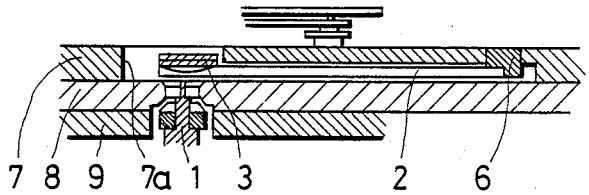
FIG. 5 is a vertical section showing another embodiment of the present invention.

FIGS. 5 to 10 show other embodiments of the present device. In the embodiment of FIG. 5, the anchor base 6 fixing one end of the spring member 2 is press-fitted in the dial plate 7. This embodiment has an advantage over the foregoing embodiment of FIG. 1, in which the anchor base 6 is press-fitted in the base plate 8. Since the anchor base 6 is fixed in the dial plate 7, according to the present embodiment, the registration between the window 7*a* of the dial plate 7 and the magnetic plate 3 or the picture plate 4 can be less offset, and the spring member 2 with the magnetic plate 3 can be assembled with a better workability as the preparations of the dial plate. The remaining effects as well as the operations are absolutely similar to those of FIG. 1.

Figure 6:
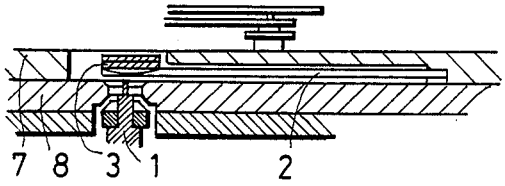
FIG. 6 is a vertical section showing another embodiment of the present invention.

In another embodiment of FIG. 6, the spring member 2 is fixed directly in the dial plate 7 to enjoy an effect that the anchor base 6 can be eliminated.

Figure 7:
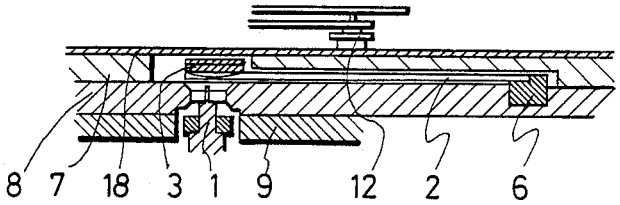
FIG. 7 is a vertical section showing another embodiment of the present invention.

In a further embodiment of FIG. 7, the magnetic plate is arranged in a recess which is formed in a transparent plate 18. This embodiment has an effect that it is possible to prevent the spring member 2 from being bent by the shocks caused when the user drops his watch and the picture plate 4 and the hour hand 12 from contacting with each other. The transparent plate 18 is superposed on the surface of the dial plate 7. The effects other than the above-specified one as well as the operations are absolutely similar to those of FIG. 1.

Figure 8:
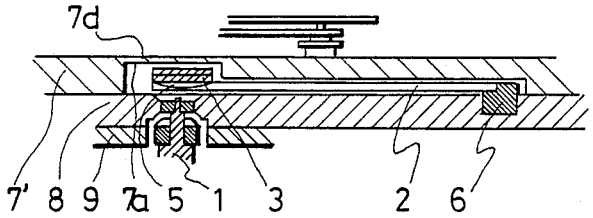
FIG. 8 is a vertical section showing another embodiment of the present invention.

In a further embodiment of FIG. 8, reference numeral 7' designates a transparent dial plate which is made of a transparent material. The window 7a of the transparent dial plate 7' is not the hole, as shown in FIG. 1, but is a recess which is formed in the back to receive the magnetic plate with effects similar to those of FIG. 5. The transparent dial plate 7' may apparently be colored with only its surface plate 7d being transparent.

Figure 9:
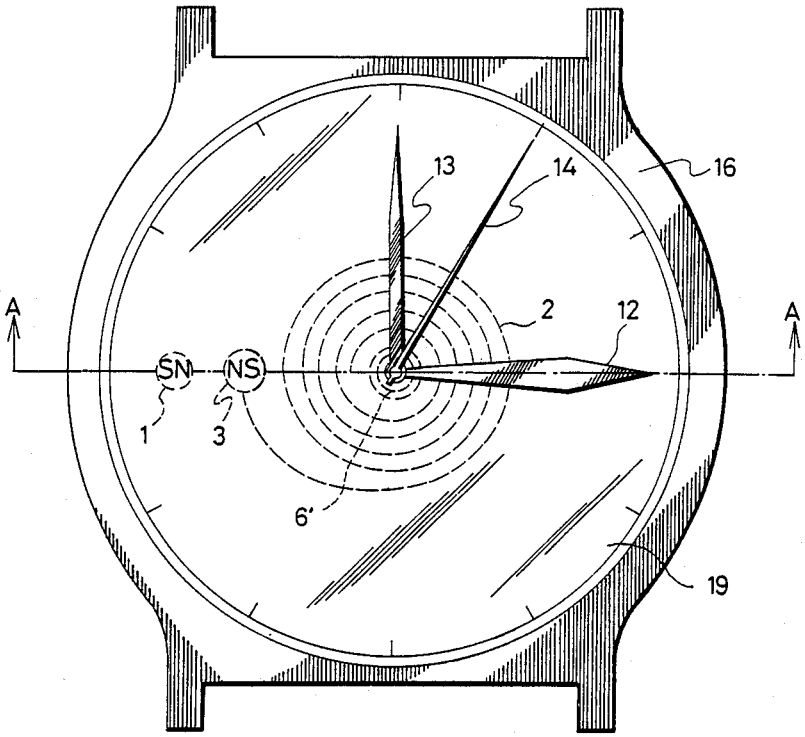
FIG. 9 is a top plane view showing an analog type watch according to another embodiment of the present invention.
Figure 10:
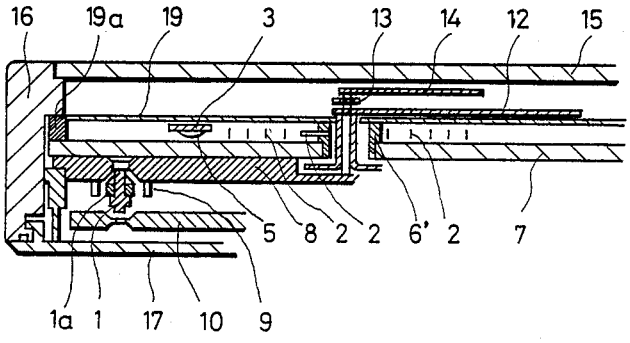
FIG. 10 is a vertical section taken along line A—A of FIG. 9.

In a further embodiment shown in FIGS. 9 and 10, the spring member 2 is formed into a spiral shape and has its one cylindrical end fixed on an anchor base 6' which has its top flanged. The other end of the spring member 2 fixedly supports the magnetic plate 3 by means of the adhesive 5 or the like. Reference numeral 19 designates a transparent plate which is made of a transparent material. This transparent plate 19 is formed on its outer circumference bottom with a ridge 19a for keeping such a clearance as to allow the magnetic plate 3 and the spring member 2 to move between but without any contact with the transparent plate 19 and the dial plate 7. The actions of the magnetic plate 3 and the magnet 1a of the rotor 1 are similar to those of FIG. 1. Thanks to the spiral shape of the spring member, the spring member 2 can give interesting rocking motions as a whole of its spiral shape when the magnetic plate 3 is attracted and then repulsed by the magnet 1a of the rotor 1 as the rotor 1 rotates.

Figure 12:
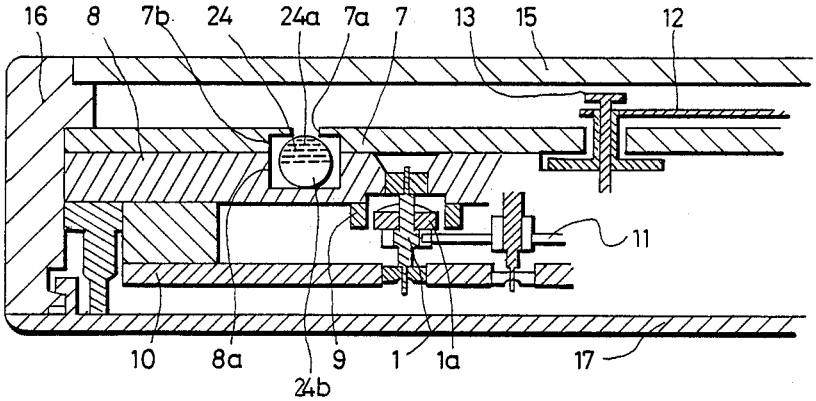
FIG. 12 is a vertical section taken along line A—A of FIG. 11.
Figure 13:
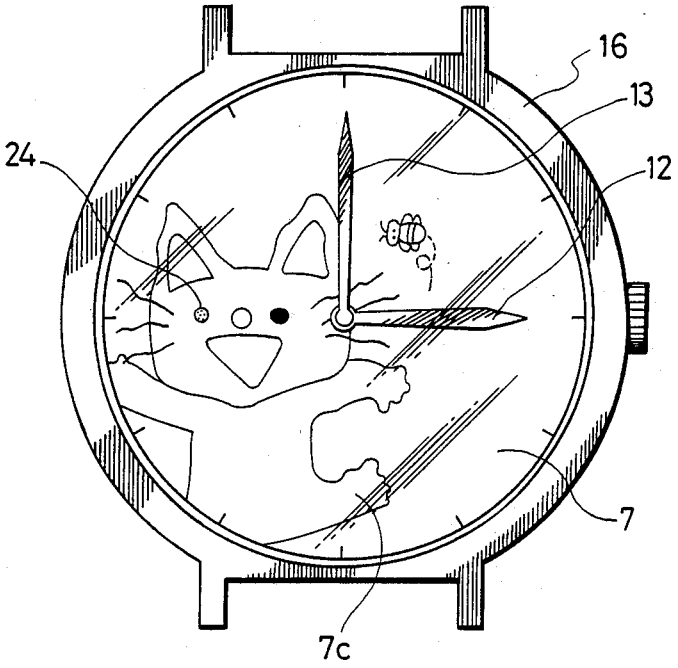
FIG. 13 is a top plane view showing an analog type watch according to another embodiment of the invention.

Another embodiment of the present invention will be described in detail in the following with reference to FIGS. 11 to 13. The dial plate, as designated at 7, is formed in its back with a cylindrical recess 7b, which has a slightly larger diameter than the true diameter of the moving magnetic member 2, and a recessed window 7a which has a smaller diameter than the true diameter of the moving magnetic member 24 for allowing the colors 24a and 24b of the moving magnetic member 24 to be confirmed. A base plate 8 is formed, in its position corresponding to the cylindrical recess 7b of the dial plate 7, with a cylindrical recess 8a which has a diameter equal to that of the cylindrical recess 7b. Between the cylindrical recess 7b of the dial plate 7 and the cylindrical recess 8a of the base plate 8, there is rotatably supported a spherical moving magnetic member 24 which is divided into N and S pole portions. Two colors 24a and 24b are printed on the moving magnetic member 24 in a separate manner such that they are offset from the divided positions of the N and S poles. Moreover, the moving magnetic member 24 is arranged within the range of the magnetic force of the rotor 1.

Next, the difference in the utilization due to the step time will be described in the following. FIG. 11 shows the dial plate 7 in the case of the watch having a long step time. In this case, the rotor 1 moves once for every 20 or 30 seconds, but the watch can be easily judged in its actual motion from the changes in the two colors 2a and 2b of the moving magnetic member 24. FIG. 13 shows the case, in which the present device is applied to a watch having an every second step. In this case, the dial plate 7 is printed with a background picture 7c such as an animal or character, which has its eye arranged in the position of the moving magnetic member 24. Thus, it is possible to provide an attractive character watch which has its visual changes enriched by the changes in the eye colors 24a and 24b for every second.

The remaining structural parts are identical to those of the mechanism of the analog type electronic watch of the prior art and will be briefly described, including the not-shown portions. If drive pulses are fed once for every second or for every 20 or 30 seconds to the coil, the magnetic poles N and S are generated around the rotor hole of the stator so that the magnet 1a of the rotor 1 is rotated by the repulsions and attractions caused between the N and S magnetic poles of the stator 9 and the N and S poles of the magnet 1a. The rotations of the rotor 1 are transmitted through several gear trains to turn a minute hand 13 and an hour hand 12.

Figure 14:
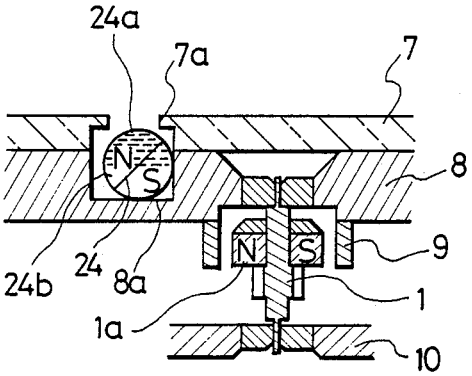
FIG. 14(*a*) is a vertical section used to explain the function of the invention.
Figure 14:
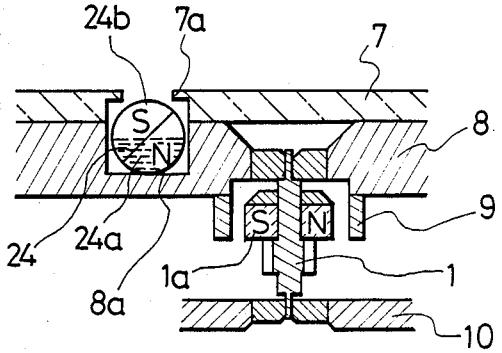

FIGS. 14(*a*) and 14(*b*) are sections showing an essential portion for explaining the operational relation between a rotor 1 and a moving magnetic member 24. The present device uses the mechanism of an analog type electronic watch of the prior art as it is. Therefore, the rotor 1 makes a rotation of 180 degrees no matter whether the watch might have two hands of a long step time or of a step time of every second. In the relation to be described, between a stator 9 and the rotor 1, the stator 9 establishes S and N poles alternately for rotating the rotor 1 so that the rotor 1 has its magnet 1a rotated by the action of the magnetic poles of the stator 9.

FIG. 14(*a*) shows the state in which the stator 9 has established the S and N poles so that the magnet 1a of the rotor 1 is stopped by the magnetic poles of the stator 9 and so that the moving magnetic member 24 has its S pole attracted to rotate by the N pole of the magnet 1a. At this time, a color 24a is observed from a window 7a of a dial plate 7. The positions of the magnetic poles N and S of the moving magnetic member 24 and the printed positions of the colors 24a and 24b are offset by the relations with the center of rotations of the moving magnetic member 24, as viewed from the window 7a of the dial plate 7.

FIG. 14(*b*) shows the state after lapse of 1 second for the watch of every second step and 20 or 30 seconds for the watch of long time step, in which magnetic poles opposite to those of FIG. 14(*a*) are generated in the stator 9 so that the rotor 1 makes a rotation of 180 degrees. In this state, the magnetic pole of the magnet 1a of the rotor 1 in the position corresponding to the moving magnetic member 24 is changed from N to S poles. As a result, the S pole of the moving magnetic member 24 is repulsive to the S pole of the magnet 1a so that the moving magnetic member 24 starts its rotations until it is stopped by the attraction between its N pole and the S pole of the magnet 1a of the rotor 1. In order words, the moving magnetic member 24 makes a rotation of 180 degrees. At this time, the color 24b is observed from the window 7a of the dial plate 7.

Next, after lapse of 1 second or after lapse of 20 or 30 seconds, the state restores to that of FIG. 14(*a*). The operations are repeated as FIG. 14(*a*)–FIG. 14(*b*)–FIG. 14(*a*)–FIG. 14(*b*).

Since the rotor 1 thus rotates 180 degrees at each second or at every 20 or 30 seconds, the moving magnetic member 24 also rotates 180 degrees so that it can be observed from the window 7a of the dial plate 7 that the colors 24a and 24b alternately change.

Figure 15:
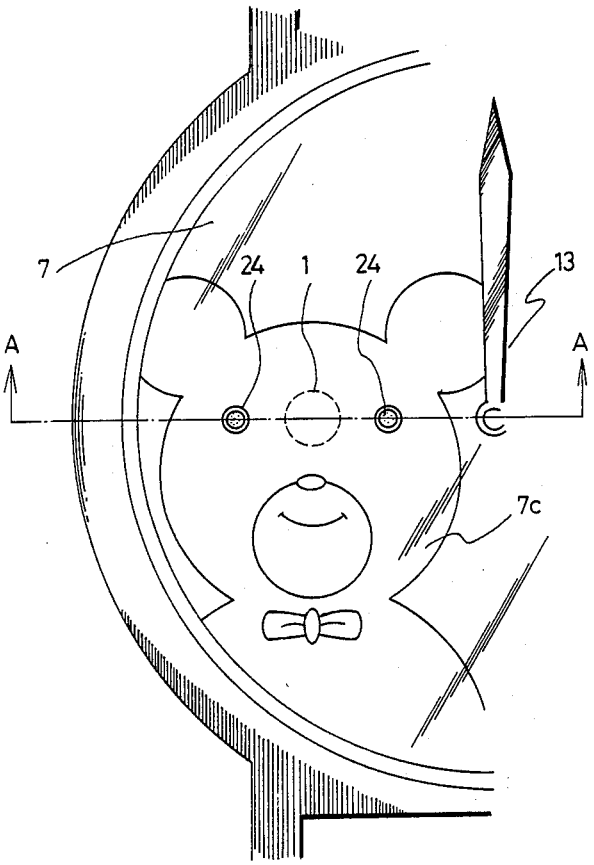
FIG. 15 is a portional top plane view showing an analog type watch according to another embodiment of the present invention.
Figure 16:
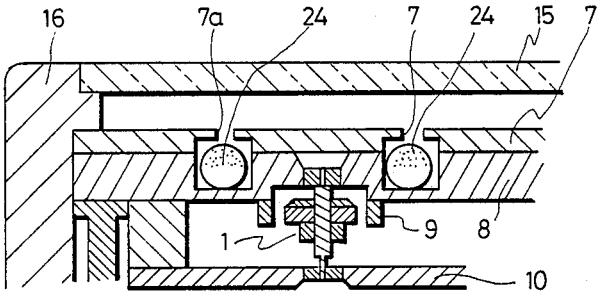
FIG. 16 is a vertical section taken along line A—A of FIG. 15.

FIGS. 15 to 21 show other embodiments of the present device. FIGS. 15 and 16 shows an embodiment, in which the moving magnetic member 2 are two in number and in which the dial plate 3 supporting the moving magnetic member 24 and the base plate 8 are formed with two cylindrical recesses *7b* and *8a*. The moving magnetic members 24 are arranged at an angular spacing of 180 degrees from each other and in positions corresponding to the still positions of the N and S poles of the magnet *1a* of the rotor 1. This embodiment can enjoy an effect that the animal or character can have two moving eyes. The operations are absolutely similar to those of FIG. 11.

Figure 17:
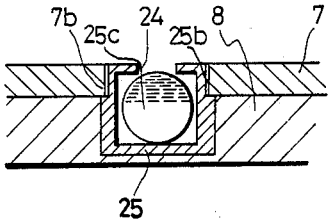
FIG. 17 is a vertical section showing another embodiment of the present invention.
Figure 18:
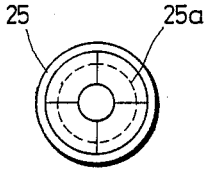
FIG. 18 is a vertical section showing another embodiment of the present invention.

A further embodiment shown in FIGS. 17 and 18 has a container 25 which is formed at its top with a window *25c* and accommodates therein a cylindrical moving magnetic member 24 made 24 made rotatable. The container 25 is interposed between the cylindrical recess *8a* of the base plate 8 and the cylindrical recess *7b* of the dial plate 7. The container 25 has its outer circumference formed with two recess *7b* of the dial plate 7 to fix the container 25 against any upward float. The moving magnetic member 24 is press-fitted in the container 25 by cutting several slits *25a* in the top surface of the container 25. If the container 25 is made of plastics, on the other hand, the moving magnetic member 24 is incorporated into the container 25 before this container 25 is molded. Since the moving magnetic member 24 is accommodated in the container 25, it can be easily handled and can be prevented from being lost when the dial plate 7 is attached or detached. The operations are also absolutely similar to those of FIG. 11.

Figure 11:
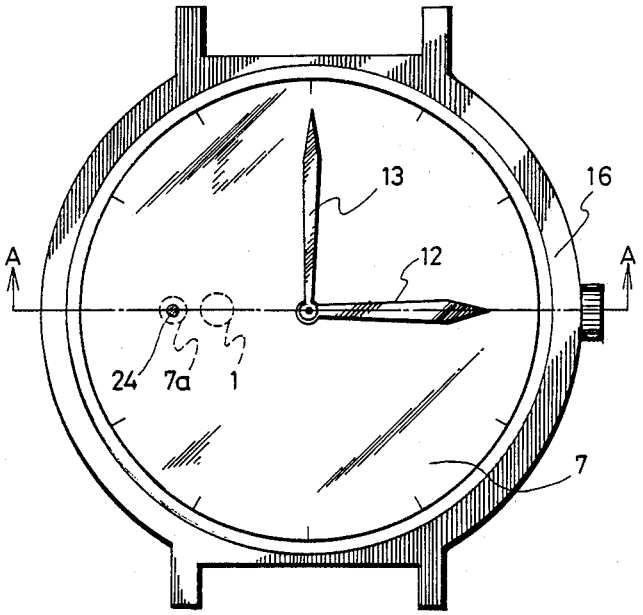
FIG. 11 is a top plane view showing a analog type watch according to further embodiment of the invention.
Figure 19:
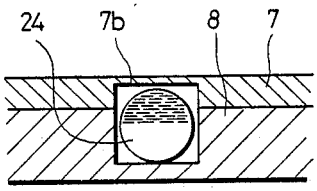
FIG. 19 is a vertical section showing another embodiment of the present invention.

FIG. 19 shows a further embodiment, in which the dial plate 3 is made of a transparent material so that the window *3a* of the dial plate 3 of FIG. 11 is omitted. An advantage obtained is that the prints of the colors *24a* and *24b* can be prevented from being rubbed off by the contact between the edge of the hole of the window *7a* and the moving magnetic member 24. The operations are also absolutely similar to those of FIG. 11.

Figure 20:
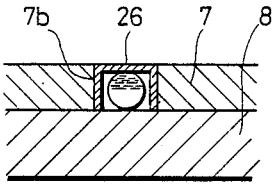
FIG. 20 is a vertical section showing another embodiment of the present invention.

FIG. 20 shows a further embodiment in which the window *7a* of the dial plate 7 and the cylindrical recess *8a* of the base plate 8 of FIG. 11 are omitted but in which a cylindrical, transparent cap 26 is fitted in the cylindrical recess *7b* of the dial plate 7. This structure raises another effect that there is no planar offset between the cylindrical recesses *7b* and *8a* of the dial plate 7 and the base plate 8. The operations are also absolutely similar to those of FIG. 11.

Figure 21:
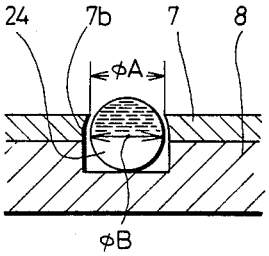
FIG. 21 is a vertical section showing another embodiment of the present invention.
Figure 22:
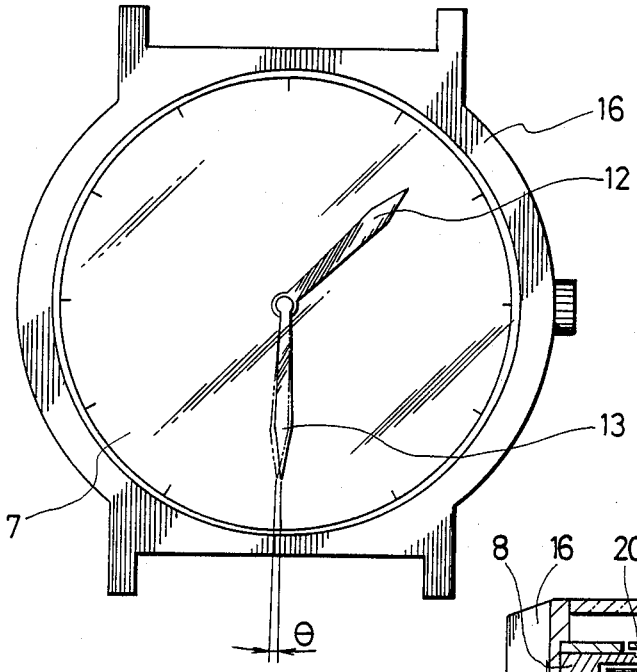
FIG. 22 PRIOR ART
FIG. 22 is a top plane view of an analog type electronic watch having two hands according to the prior art.
Figure 24:
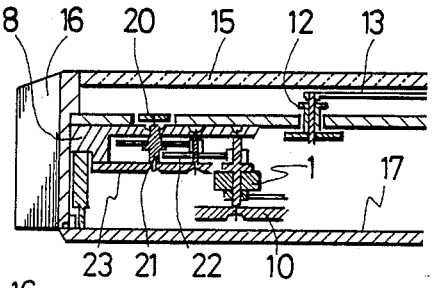
FIG. 24 PRIOR ART
FIG. 24 is a vertical section taken along line A—A of FIG. 24.
Figure 23:
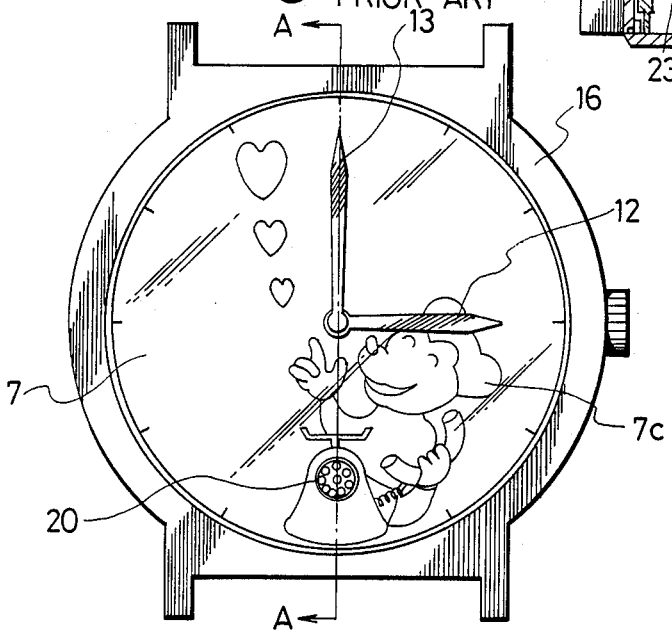
FIG. 23 PRIOR ART
FIG. 23 is a top plane view of an analog type electronic watch having movement indicater disk according to the prior art.

FIG. 21 shows a further embodiment in which the cylindrical recess *7b* of the dial plate 7 is shaped to have a curvature near that of the spherical shape of the moving magnetic member 24. The diameter A of the top surface of the cylindrical recess *7b* is made slightly smaller than the diameter B of the moving magnetic member 24 so that the latter 24 may slightly protrude from the top surface of the cylindrical recess *7b* of the dial plate 7. The effect obtained is that the moving magnetic member 24 can appear streoscopic.

Notwithstanding that the present invention has a simple structure in which the moving magnetic member is arranged within the range of the magnetic force of the magnet of the rotor, as has been described hereinbefore, a two-handed watch having a long step time can be easily confirmed whether or not it is actually moving, in view of the changes in the two colors printed on the moving magnetic member or the motion of the moving magnetic member, which is looked as if it not only moved to the right and left on a plane but also flew, so that it can keep the user from being anxious about the time. For a watch of an every second step, on the other hand, it is possible to provide an attractive character watch in which the moving member can be moved to enrich the visual changes, and to expand its design in various modes and for various purposes.

What is claimed is:

1. An analog type electronic watch for indicating the time by driving a gear train by means of a step motor including a rotor which exhibits a magnetic force, a stator and a coil block; said watch comprising:

a dial plate having a window portion within the range of influence of the magnetic force of said rotor, a magnetic member arranged within said window portion so as to be synchronously moved by the magnetic force in accordance with the rotation of said rotor for acting as movement indicator, and supporting means for supporting said magnetic member.

2. An analog type electronic watch as claimed in claim 1, wherein said magnetic member has a shape of a sphere.

3. An analog type electronic watch as claimed in claim 2, wherein said magnetic member has portions thereof divided in two colors.

4. An analog type electronic watch as claimed in claim 2, wherein said supporting means includes a recess formed in a base plate and said magnetic member is rotatably supported in said recess.

5. An analog type electronic watch as claimed in claim I, wherein said magnetic member has a shape of a plate.

6. An analog type electronic watch as claimed in claim 5, wherein said magnetic member is printed with a picture.

7. An analog type electronic watch as claimed in claim 5, wherein said supporting means includes a spring member having its one end supported by a base plate.

8. An analog type electronic watch as claimed in claim 7, wherein said spring member has a shape of a spiral.

* * * * *